US009480617B1

(12) United States Patent
Cook

(10) Patent No.: US 9,480,617 B1
(45) Date of Patent: Nov. 1, 2016

(54) BURIAL SYSTEM AND METHOD

(71) Applicant: Byron M. Cook, Pensacola, FL (US)

(72) Inventor: Byron M. Cook, Pensacola, FL (US)

( * ) Notice: Subject to any disclaimer, the term of this patent is extended or adjusted under 35 U.S.C. 154(b) by 0 days.

(21) Appl. No.: 14/744,284

(22) Filed: Jun. 19, 2015

Related U.S. Application Data

(60) Provisional application No. 62/014,179, filed on Jun. 19, 2014.

(51) Int. Cl.
*A61G 17/04* (2006.01)
*E04H 13/00* (2006.01)

(52) U.S. Cl.
CPC ..... *A61G 17/04* (2013.01); *E04H 13/005* (2013.01); *A61G 2017/048* (2013.01)

(58) Field of Classification Search
CPC ..... A61G 17/04; A61G 2017/048; A61G 17/06; A61G 17/002; B65D 77/225; E04H 13/005
USPC ..... 27/2, 11, 28, 35; 383/100; 52/129, 130, 52/132–134
See application file for complete search history.

(56) References Cited

U.S. PATENT DOCUMENTS 3,257,820 A * 6/1966 Case ..... F25D 3/105 27/11
3,938,287 A * 2/1976 Gauchard ..... E04H 13/005 27/1
3,945,094 A * 3/1976 Daran ..... E04H 13/005 27/11
4,879,789 A * 11/1989 Bak ..... A01N 1/00 27/11
4,924,565 A * 5/1990 Rathjen ..... A61G 17/02 27/11
5,568,677 A * 10/1996 Tobin ..... A61G 17/00 220/806
5,659,932 A * 8/1997 Wright ..... A01N 1/00 27/17
5,926,929 A * 7/1999 MacKirdy ..... A61G 17/04 27/11
7,171,733 B2 * 2/2007 Min ..... E04H 13/006 27/1
8,240,013 B2 * 8/2012 Williamson ..... A61G 17/00 27/14
8,695,184 B1 * 4/2014 Mikat ..... A61G 17/00 27/11
8,955,205 B2 * 2/2015 Beliveau ..... A61G 17/0076 16/424
2010/0186207 A1 * 7/2010 Moore ..... A61G 17/02 27/1
2013/0067705 A1 * 3/2013 Williamson ..... A61G 17/007 27/14
2014/0223706 A1 * 8/2014 Abrams ..... A61G 17/007 27/3

* cited by examiner

*Primary Examiner* — William Miller
(74) *Attorney, Agent, or Firm* — J. Nevin Shaffer, Jr.

(57) ABSTRACT

A burial system and method includes a container with an outer shell surrounding an interior containment space where the container is configured to retain biological remains in the interior containment space. A pressure relief valve is connected with the container where the pressure relief valve is a one-way valve for release of pressure from the interior containment space. An input valve is connected with the container where the input valve is a one-way valve for the introduction of material to the interior containment space. At least one sensor device is connected with the container where the at least one sensor device monitors and obtains data from the interior containment space and the exterior of the container. A management information system is connected with the container where the management information system maintains real time and historical data of the container.

20 Claims, 4 Drawing Sheets

BURIAL SYSTEM AND METHOD

CROSS REFERENCE TO RELATED APPLICATION

This application claims the benefit of previously filed U.S. provisional patent application No. 62/014,179 filed Jun. 19, 2014 for an "Above Ground Burial Storage System and Method". The Applicant hereby claims the benefit of this provisional application under 35 U.S.C. §119. The entire content of this provisional application is incorporated herein by this reference.

FIELD OF THE INVENTION

This invention relates to an improved burial system and method. In particular, in accordance with one embodiment, the invention relates to a burial system consisting of a container with an outer shell surrounding an interior containment space where the container is configured to retain biological remains in the interior containment space. A pressure relief valve is connected with the container where the pressure relief valve is a one-way valve for release of pressure from the interior containment space. An input valve is connected with the container where the input valve is a one-way valve for the introduction of material to the interior containment space. At least one sensor device is connected with the container where the at least one sensor device monitors and obtains data from the interior containment space and the exterior of the container. A management information system is connected with the container where the management information system maintains real time and historical data of the container.

BACKGROUND OF THE INVENTION

A problem exists with regard to the handling and disposal of biological remains. In particular, there are problems with the present state of the art for the handling and disposition of human remains. In-ground burial dates back to over 100,000 years in our human civilization. The importance of the proper burial of the dead was emphasized by every ancient culture—from ancient Mesopotamia to Egypt to the Mayans, and the Greeks and Romans. The rites accompanying ancient burial were elaborate and significant so the dead were well prepared for the journey to the afterlife. Today, at the end of their life, nearly everyone will choose some sort of burial or cremation. With the rapid growth in population in the last 100 years, and increased migration of families due to job relocations and retirement, being able to be buried in a family plot is no longer an option for most people. Further, with the sharp rise in the cost of burial, concerns about overcrowding and poor maintenance in cemeteries and new rules about land use and the environment, in-ground burial no longer seems feasible and may become a thing of the past. There are over 120,000 cemeteries in America that belong to families, non-profits and service the death industry based on a centuries old system of in-ground burial—what is called in market research a "legacy-based system"—and they are simply running out of room for burial except in the most remote locations.

Death, like other businesses must deal with supply and demand. It is no secret that the biggest factor affecting the quality of burial both today and long-term has been the rapid population growth in the last 100 years. Burial is a part of life and death and must considered carefully and thoughtfully.

Thus, there is a need in the art for a burial system and method that is responsive the concerns of society as a whole including environmentalists as well as the families of the bereaved.

It, therefore, is an object of the present invention to provide a burial system and method that does not adversely impact the environment while at the same time it provides an improved burial option that is responsive to the needs of the families of the deceased as well.

SUMMARY OF THE INVENTION

Accordingly, the burial system and method of the present invention, according to one embodiment, includes a container with an outer shell surrounding an interior containment space where the container is configured to retain biological remains in the interior containment space. A pressure relief valve is connected with the container where the pressure relief valve is a one-way valve for release of pressure from the interior containment space. An input valve is connected with the container where the input valve is a one-way valve for the introduction of material to the interior containment space. At least one sensor device is connected with the container where the at least one sensor device monitors and obtains data from the interior containment space and the exterior of the container. A management information system is connected with the container where the management information system maintains real time and historical data of the container.

All terms used herein are given their common meaning so that "container" identifies and describes a receptacle of any desired dimension and form where the receptacle includes an outer shell or exterior surface surrounding an interior containment space.

The container may include removable and replaceable top or side or end sections for the insertion of biological remains into the interior containment space. Importantly, however, once the biological remains are paced in the interior containment space, the interior containment space is only connected with the outside by means of a pressure relief valve and an input valve. While the preferred embodiment is biological remains, and human remains at that, certainly the invention is not so limited and may be utilized for the containment, observation and accounting for any material or object retained within the container.

The pressure relief valve is a one-way valve configured to release pressure, such as decomposition gasses, for example only, from the interior containment space. The input valve is a one-way valve configured to introduce material to the interior containment space, such as decontamination sprays or cleaning fluids, for example only, as may be desired, even prior to opening should the container be required to be re-opened after remains have been sealed within.

Additionally, at least one "sensor device" is connected with the container. As used herein, the term "sensor device" includes any device now known or hereafter developed for obtaining and transmitting data such as video, audio, temperature, pressure, and the like, for example only, from both the interior and exterior of the container. By "connected" it is understood that a physical connection to the container including, for example only, a camera observation hole or pressure port, sealed against leakage into or out of the container, is included within the scope of the invention. Additionally, the sensor device(s) may be remotely located and only visually connected with the container, as for example, a camera spaced apart from but directed at the container.

Further, a "management information system" is connected with the container where the management information system maintains real time and historical data of the container. As used herein the term "management information system" is used in its common form to denote a computer system for receiving, recording and maintaining data including but not limited to data from the at least one sensor device. Such computer systems are known and not described more fully hereafter and include, for example only and not by way of limitation, PC's, lap tops, tablets, smart phones, cloud based devices and systems and networks of all known types used for the purpose of managing collected data.

According to another aspect of the invention, the system further includes more than one container and the management information system includes a central data center for recording real time and historical data of each of the more than one container and where the data includes data from a group of data consisting of: audible, visual and written data.

The term "central data center" is used herein in its common meaning to describe a location, a server, the "Cloud", etc. for example only, at which all data concerning each and every container is maintained. The central data center is accessible in any desired manner via intranet or internet or Cloud connections and protected for privacy as is known in the art. In another aspect, the real time and historical data includes the location of the containers, the contents of the containers, and customer information relating to the containers.

In one aspect, the system further includes a Radio Frequency Identification (RFID) tag connected with the container.

In another aspect, the system further includes a gender label on the exterior of the container.

In one aspect, the system further includes a biohazard label on the exterior of the container.

One aspect of the system further includes an attachment device configured to connect the container with an object. The "attachment device" may be any device or combination of devices, such as pins, bolts, latches and the like, for connection of one container to another or for connection of one container to some separate object as will be described more fully hereafter.

In one aspect, the attachment device is remotely operable and the object to which the container is connected is a pod cage for storage of more than one container. By "remotely operable" a device is described that is electronically controlled, for example only, and that may be open and shut, extended or retracted, or raised or lowered, from a remote location by means of the management information computer system, for example, or by a hand held remote, as is known in the art.

Further, this aspect of the invention includes a "pod cage". As used herein and described more fully hereafter, a "pod cage" describes a cage or grid like structure to which containers are attached and by which containers are held in fixed location.

In another aspect, the pressure relief valve is connected with plumbing directing material released by the pressure relief valve away from the container. "Plumbing" describes pipes and conduits connected on one end with the pressure relief valve and on the other end directed to a location at which material released from the interior containment space is safely treated and disposed such that the material is prevented from entering the environment in hazardous form.

According to another embodiment of the invention, a burial system for containing and monitoring human remains is provided, the burial system including a plurality of remains containers where each remains container includes an outer shell surrounding an interior containment space and where each of the remains containers is configured to retain human remains in the interior containment space. A pressure relief valve is connected with each of the remains containers where the pressure relief valve is a one-way valve for release of pressure from the interior containment space. An input valve is connected with each of the remains containers where the input valve is a one-way valve for the introduction of material to the interior containment space. At least one sensor device is connected with each of the remains containers where the at least one sensor device monitors and obtains data from the interior containment space and the exterior of each of the remains containers. A management information system is connected with each of the remains containers where the management information system maintains real time and historical data of each of the remains containers, including but not limited to data from the at least one sensor device, where the management information system includes a central data center for recording real time and historical data of each of the remains containers and where the central data center is connected with a network for management and customer access to the real time and historical data and where the real time and historical data includes data from a group of data consisting of: audible, visual and written data relating to the remains containers.

In other aspects of this invention, the system further includes an RFID tag connected with each of the remains containers; a gender label on the exterior of each of the remains containers; or a biohazard label on the exterior of each of the remains containers.

In further aspects, the system further includes an attachment device configured to connect the remains container with an object; and one where the attachment device is remotely operable and where the object is a pod cage for storage of more than one remains container.

In another aspect, the pressure relief valve is connected with plumbing directing material released by the pressure relief valve away from the remains container.

According to another embodiment of the invention, a burial method consists of:

a. providing a container with an outer shell surrounding an interior containment space where the container is configured to retain biological remains in the interior containment space; a pressure relief valve connected with the container where the pressure relief valve is a one-way valve for release of pressure from the interior containment space; an input valve connected with the container where the input valve is a one-way valve for the introduction of material to the interior containment space; at least one sensor device connected with the container where the at least one sensor device monitors and obtains data from the interior containment space and the exterior of the container; and a management information system connected with the container where the management information system maintains real time and historical data of the container where the data includes data from a group of data consisting of: audible, visual and written data; and b. accessing the management information system and retrieving the real time and historical data of the container.

In another aspect, the invention further includes the steps of providing more than one container and connecting each container with another container in an arrangement selected from a group of arrangements consisting of: vertical stacking arrangement, horizontal stacking arrangement and a combination of vertical and horizontal stacking arrangements.

One aspect further includes the steps of providing a pod cage where the pod cage is conformed to receive and retain a plurality of the containers and connecting each of the plurality of containers with the pod cage.

In a further aspect, the management information system includes a central data center for recording real time and historical data of a plurality of containers where the central data center is connected with a network for management and customer access to the real time and historical data and where the real time and historical data includes the location of each of the containers, the contents of each of the containers, and customer information relating to each of the containers.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
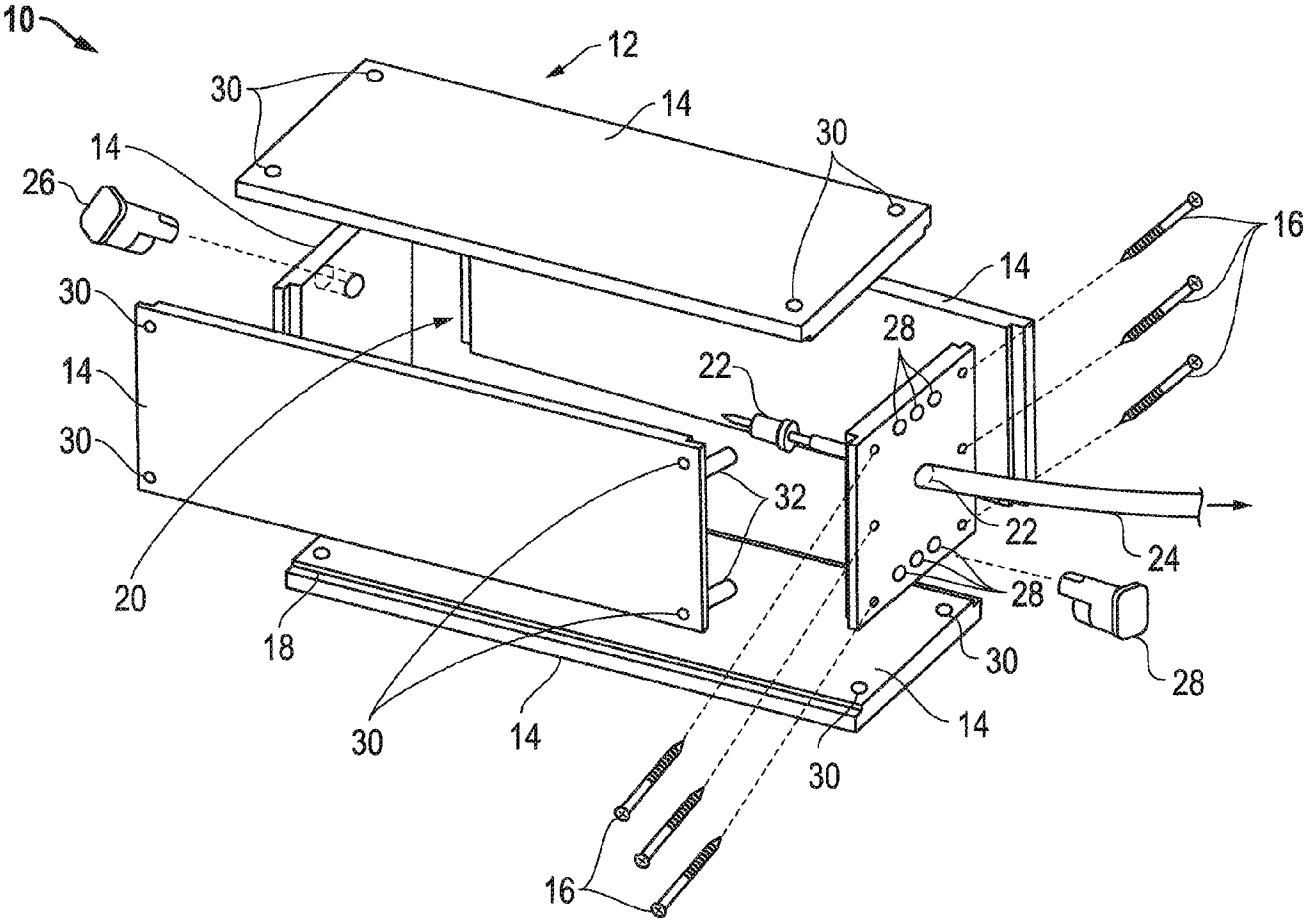
FIG. 1 is an exploded view of the container of the burial system of the present invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated. For example, further insubstantial approximations of the process and/or algorithms are also considered within the scope of the processes described herein.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware and software based devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

A preferred embodiment of the present invention is illustrated by way of example in FIGS. 1-5. With specific reference to FIG. 1, burial system 10 includes container 12. Container 12 includes an outer shell 14. Outer shell 14 may be made up from separate sections, as illustrated. For example only and not by way of limitation, outer shell 14 includes: top panel A, side panel B, side panel C, end panel D, end panel E and bottom panel F. These panels are joined securely together by use of screws 16 and tongue and groove combinations 18 as shown or in any other way now known or hereafter developed so long as an air tight interior containment space 20 is created. Biological remains (not shown) are added to the interior containment space 20 prior to sealing container 12. Once container 12 is sealed, again, interior containment space 20 is completely sealed off from the outside. That is, once sealed, container 12 prevents anything outside container 12, water, gases, dirt, etc. into it and, likewise, prevents fluids, gases and debris, etc, out of it.

Container 12 further includes a pressure relief valve 22. Pressure relief valve 22 is a one-way valve such that gases produced by decaying biological matter, for example, within sealed interior containment space 20 are released through pressure relief valve 22 but nothing passes from the outside through pressure relief valve 22 into interior containment space 20. In one aspect, pressure relief valve 22 is connected with plumbing 24. Plumbing 24 is connected with pressure relief valve 22 and collects escaped gases and directs them to a location for treatment of the gases (not shown) prior to release of the treated gases to the environment.

Input valve 26 is connected with container 12. Input valve 26 is a one-way valve into the interior containment space 20. Input valve 26 enables the controlled introduction of material when desired or deemed necessary. For example only, the user may determine that the container 12 previously sealed needs to be opened. While pressure relief valve 22 eliminates gases and pressure from the interior containment space 20, it may be useful to introduce disinfectants, for example only, prior to opening.

Container 12 also includes at least one sensor device 28. FIG. 1 shows one large sensor device 28 and six other smaller sensor devices 28 in end panel E. Sensor device(s) 28 are configured to monitor and obtain data from both the interior containment space 20 and the exterior of container 12. The scope of the purpose of the sensor devices 28 includes receiving, recording and/or transmitting data from, again, both the inside and the outside of container 12.

FIG. 1 also illustrates attachment device 30. Attachment device 30 consists, preferably, of metal pins that are configured to connect with receivers (not shown) in another container and thereby connect the containers 12 together. Attachment device 30 may include a solenoid 32 for remote activation of the attachment device 30, pins, for example only.

Figure 2:
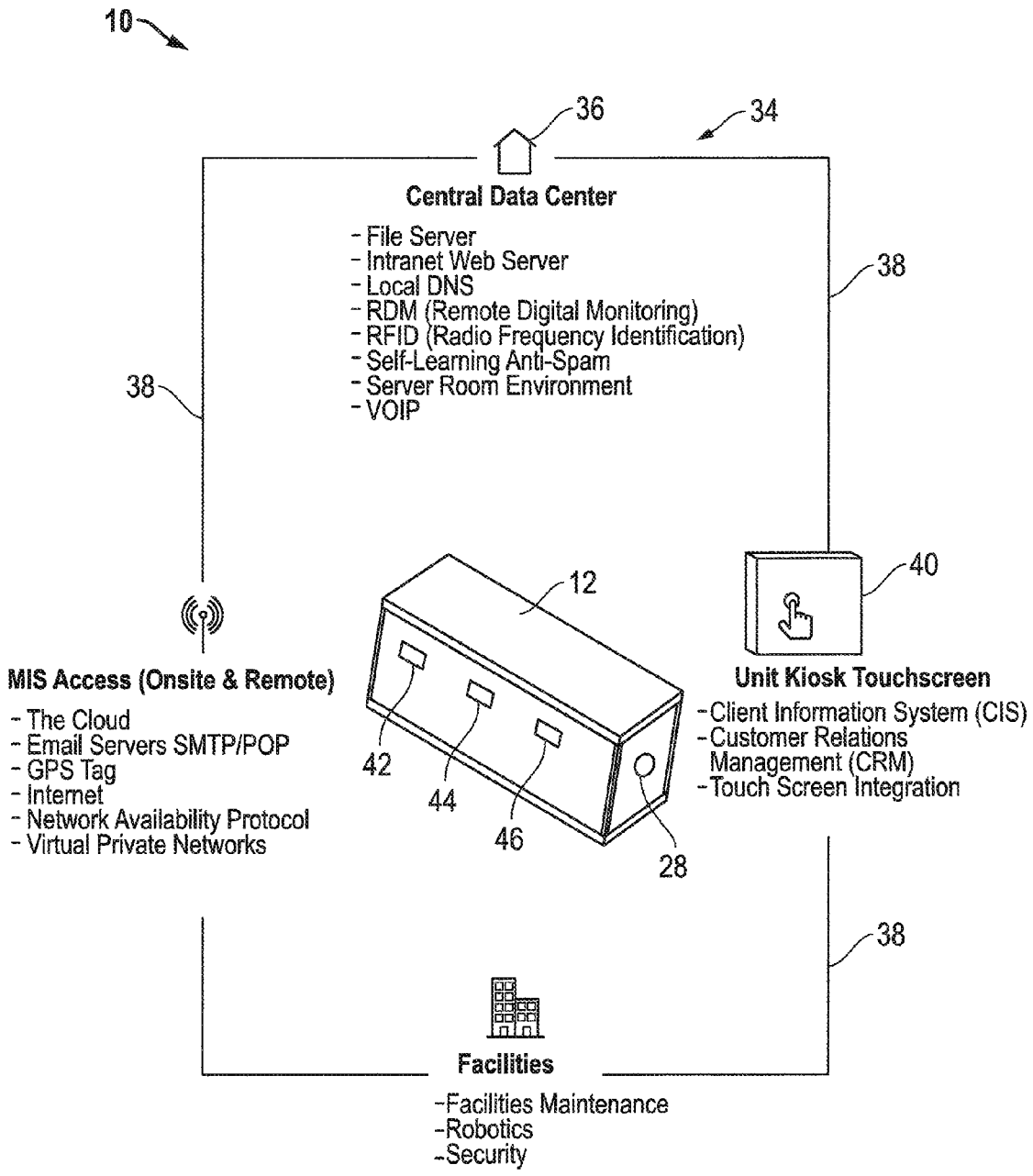
FIG. 2 is a schematic view of the invention of FIG. 1 illustrating connection of the burial system with the management information systems and the central data center.

Referring now to FIG. 2, management information system 34 is described. Broadly speaking, management information system 34 is "connected" with container 12 and management information system 34 maintains real time and historical data of each container 12. Importantly, in one aspect, management information system 34 includes a central data center 36. Central data center 36 provides a single location for the maintenance of data and thus provides the ability to control and monitor access to the data. Central data center 36 receives and retains and processes real time and historical data of each of the more than one containers 12. That data includes data from a group of data consisting of: audible, visual and written data whereby a user of the present invention can not only read a report about the history of any particular container 12, but can see and hear what is happening or has happened both inside and outside of any particular container 12. Importantly, the management information system 34 and central data center 36 obtain and retain real time and historical data that, among other things, includes the location of the containers 12, the contents of the containers 12, and customer information relating to the containers 12.

Management information system 34 is "connected" in any useful manner such as through a network 38. Network 38 may be any network now known or hereafter developed, wired, wireless, intra or inter, local or global. As such, management information system 34 receives input from sensor device 28 from each container 12, for example, as well as input from management and customers. Management may enter accounting data relevant to one or more containers 12 and their location costs, for example. Customers may access and enter data, such as visitation times and remarks, such as through a kiosk 40 on site, for example only.

Container 12 may also include an RFID tag 42 connected with each of the remains containers 12; a gender label 44 on the exterior of each of the remains containers 12; and/or a biohazard label 46 on the exterior of each of the remains containers 12.

Figure 3:
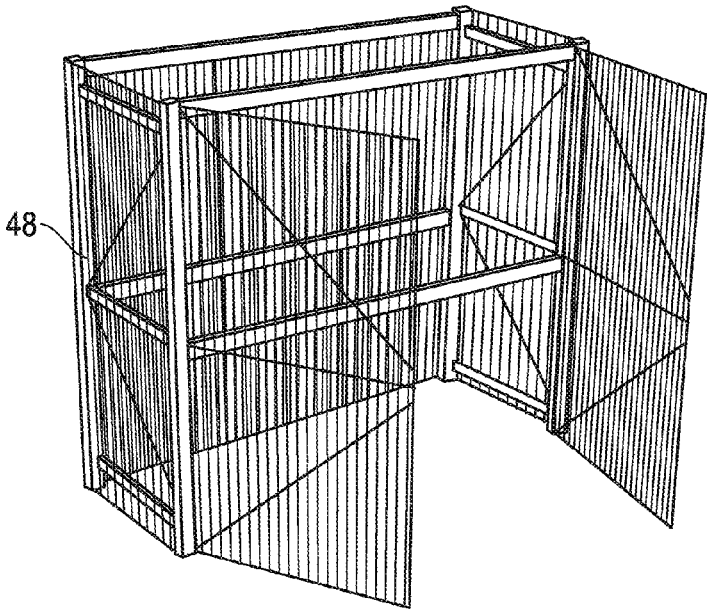
FIG. 3 is a perspective view of the pod cage of the present invention open.
Figure 4:
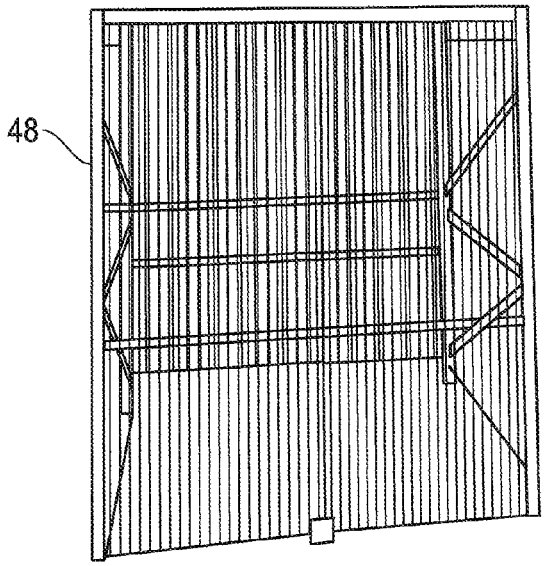
FIG. 4 is a perspective view of the pod cage of FIG. 3 closed.

Referring now to FIGS. 3 and 4, one aspect of the invention includes a pod cage 48. Pod cage 28 is a light weight sturdy structure configured to be anchored in a particular desired location. Pod cage 48 is also configured to receive and retain containers 12 (not shown). In use, several containers 12 are located within open pod cage 48 (FIG. 3) and then pod cage 48 is closed (FIG. 4). Because pod cage 48 is anchored in a particular location by any anchoring means now known or hereafter developed, once container 12 is closed inside pod cage 48, container 12 is fixed in a secure location. Attachment device 30 may be used to secure containers 12 to pod cage 48 as well.

Figure 5:
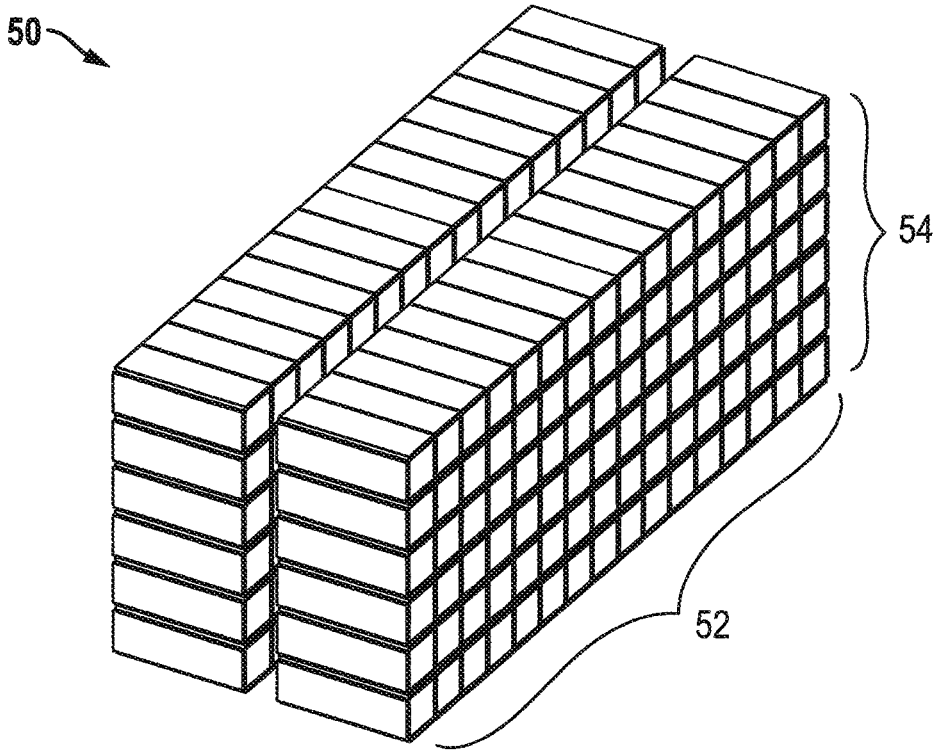
FIG. 5 is a perspective view illustrating both vertical and horizontal stacking of the invention of FIG. 1.

Referring to FIG. 5, as should be understood by now, the burial system and method 10 of the present invention provides a unique ability to safely handle and store and account for biological, human, remains in an environmentally sensitive and secure manner. One important advantage of the present invention is that users are enabled to aggregate containers 12 in a space saving manner by any desired stacking arrangement 50. FIG. 5 illustrates a combination of both horizontal stacking 52 and vertical stacking 54.

By way of continued description, burial system and method 10 is a proprietary above-ground (including off-planet) burial system comprised of modular burial units, containers 12, that use a proprietary integrated technology-based management information system 34 that is accessed via sensors and other transmit-receive devices that are imbedded "pre-market" in the container 12 during manufacture. The management information system 34 monitors and manages each container 12 for containment location, remains identification, violations and degradation, among other things.

The modular burial unit containers 12 may be constructed of extruded or injection-molded polypropylene resins with compound additives for flame retardancy, moisture penetration barrier control and closing seal bonding affinity.

Some of the advantages of the present invention that are non-obvious improvements over the prior art of a traditional in-ground crypt burial are:

a.) above-ground installation which addresses environmental and land use issues (reduction by 50-60%) of the prior art; extends the life of the burial site in situ.

b.) modular mass production, construction and flexible modularization options to create efficient monolithic burial structures;

c.) integrated management information system 34 and technology for monitoring and management both during construction and post-burial to overcome issues in the prior art of in-ground burial such as cost, degradation, violations, remains identification, family record keeping and location tracking Note: No post-burial management in prior art of traditional in-ground crypt burial.

The management information system 34 may consist of a combination of existing technologies, e.g., the internet, the cloud, robotics, RDM (remote digital monitoring), RFID (radio frequency identification) and GPS (global positioning system) to transmit, monitor, record and manage each burial unit during construction and post-burial. This information includes but is not limited to both interior and exterior environmental degradation and violations, remains identification and containment location.

By way of continued explanation, and referring to FIG. 2, the management information system 34 central data center 36 may include some of the following elements:

File Server—a computer attached to a network that has the primary purpose of providing a location for shared disk access, i.e. shared storage of computer files (such as documents, sound files, photographs, movies, images, databases, etc.) that can be accessed by the workstations that are attached to the same computer network. The term server highlights the role of the machine in the client-server scheme, where the clients are the workstations using the storage. A file server is not intended to perform computational tasks, and does not run programs on behalf of its clients. It is designed primarily to enable the storage and retrieval of data while the computation is carried out by other dedicated workstations.

Intranet Web Server—a computer network server that uses Internet Protocol technology to share information, operational systems, or computing services within an organization. This term is used in contrast to extranet, a network between organizations, and instead refers to a network within an organization. Sometimes, the term refers only to the organization's internal website, but may be a more extensive part of the organization's information technology infrastructure, and may be composed of multiple local area networks. The objective is to organize each individual's desktop with minimal cost, time and effort to be more productive, cost efficient, timely, and competitive.

An intranet may host multiple private websites and constitute an important component and focal point of internal communication and collaboration. Any of the well known Internet protocols may be found in an intranet, such as HTTP (web services), SMTP (e-mail), and FTP (file transfer protocol). Internet technologies are often deployed to provide modern interfaces to legacy information systems hosting corporate data.

Local DNS—DNS (domain name server) is a hierarchical distributed naming system for computers, services, or any resource connected to the Internet or a private network. The local Domain Name System distributes the responsibility of assigning domain names and mapping those names to IP addresses by designating authoritative name servers for each domain. Authoritative name servers are assigned to be responsible for their supported domains, and may delegate authority over sub-domains to other name servers. This mechanism provides distributed and fault tolerant service and was designed to avoid the need for a single central database.

RDM (Remote Digital Monitoring)—Remote digital monitoring and control refers to a field of computerized monitoring using wireless sensing devices. Remote monitoring and control refers to the measurement of disparate devices from a network operations center or control room and the ability to change the operation of these devices from that central office.

RFID (Remote Frequency Identification)—the wireless use of electromagnetic fields to transfer data, for the purposes of automatically identifying and tracking tags attached to objects. The tags contain electronically stored information. Some tags are powered by electromagnetic induction from magnetic fields produced near the reader. Some types collect energy from the interrogating radio waves and act as a passive transponder. Other types have a local power source such as a battery and may operate at hundreds of meters from the reader. Unlike a barcode, the tag does not necessarily need to be within line of sight of the reader, and may be embedded in the tracked object. Radio frequency identification (RFID) is one method for Automatic Identification and Data Capture (AIDC) for the present invention.

Self Learning Anti-Spam—a baseline technique in a mail-filtering program for dealing with spam that can tailor itself to the email needs of individual users and give low false positive spam detection rates that are acceptable to users requiring multiple levels of security.

Server Room Environment—Also known as data center environmental control, is a constructive generic framework for maintaining temperature, humidity, and other physical qualities of air within a specific range in order to allow the equipment housed in a data center to perform optimally throughout its lifespan.

VOIP—voice over internet protocol. The delivery of communications services, voice communications and multimedia sessions over Internet Protocol (IP) networks, (voice, fax, SMS, voice-messaging), rather than via the public switched telephone network (PSTN). VOIP is available, on Internet access devices. Calls and SMS text messages may be sent over 3G or Wi-Fi, on many smartphones and personal computers.

Access to the management information system 34 may include (Onsite and Remote):

The Cloud—Cloud computing is a recently evolved computing terminology or metaphor based on utility and consumption of computing resources. Cloud computing involves deploying groups of remote servers and software INK"http://en.wikipedia.org/wiki/Computer_network" networks that allow centralized data storage and online access to computer services or resources. Clouds can be classified as public, private or hybrid.

Email Servers SMTP/POP—is a method of authorization used by mail server software which helps allow users the option to send e-mail from any location, as long as they can demonstrably also fetch their mail from the same place. The main advantage of this process is that it is generally transparent to the average user who will be connecting with an email client, which will almost always make a connection to fetch new mail before sending new mail. Those users not handled by this method need to resort to other authorization methods. Also, in cases where users come from externally controlled dial-up addresses (more specifically, all dynamically assigned addresses), the SMTP server must be careful about not giving too much leeway when allowing unauthorized connections, because of a possibility of race conditions leaving an open mail relay unintentionally exposed.

GPS tag—a burial unit location tracking device using pre-market embedded sensors which have transmission triangulation tracking capability via the Global Positioning System, a space-based satellite navigation system that provides location and time information in all weather conditions, anywhere on or near the Earth where there is an unobstructed line of sight to four or more GPS satellites.

Internet—a global system of interconnected computer networks that use the standard Internet protocol suite (TCP/IP) to link several billion devices worldwide. It is a network of networks that consists of millions of private, public, academic, business, and government networks of local to global scope, linked by a broad array of electronic, wireless, and optical networking technologies. The Internet carries an extensive range of information resources and services, such as the inter-linked hypertext documents and applications of the World Wide Web (WWW), the infrastructure to support email, and peer-to-peer networks for file sharing and telephony.

Network Availability Protocol—a system of digital rules for data exchange within or between computers. Communicating systems use well-defined formats (protocol) for exchanging messages. Each message has an exact meaning intended to elicit a response from a range of possible responses pre-determined for that particular situation. Thus, a protocol must define the syntax, semantics, and synchronization of communication; the specified behavior is typically independent of how it is to be implemented. A protocol can therefore be implemented as hardware, software, or both. Communication protocols have to be agreed upon by the parties involved.

Virtual Private Networks—or VPN. Extends a private network across a public network, such as the Internet. It enables a computer or network-enabled device to send and receive data across shared or public networks as if it were directly connected to the private network, while benefiting from the functionality, security and management policies of the private network. A VPN is created by establishing a virtual point-to-point connection through the use of dedicated connections, virtual tunneling protocols, or traffic encryptions. Major implementations of VPNs include Open VPN and IPsec. A VPN connection across the Internet is similar to a wide area network (WAN) link between websites.

Unit Kiosk 40 Touchscreen may include:

Client Information Systems (CIS)—any method used to access, collect, store, use, transmit, protect, or dispose of customer information.

Customer Relations Management (CRM)—a system for managing a company's interactions with current and future customers. It often involves using technology to organize, automate, and synchronize sales, marketing, customer service, and technical support.

Touch Screen Integration—an electronic visual display that the user can control through simple or multi-touch gestures by touching the screen with a special stylus/pen and-or one or more fingers. The user can use the touchscreen to react and interact to what is displayed and to control how it is displayed (for example by zooming the text size).

Facilities for the operation of the burial system and method 10 may include:

Facilities Maintenance—Facilities maintenance, repair and operations (MRO) or maintenance, repair, and overhaul involves fixing any sort of mechanical, plumbing or electrical device should it become out of order or broken. It also includes performing routine actions which keep the device in working order (known as scheduled maintenance) or prevent trouble from arising (preventive maintenance) during the normal operation of a facility. MRO may be defined as, "All actions which have the objective of retaining or restoring an item in or to a state in which it can perform its required function. The actions include the combination of all technical and corresponding administrative, managerial, and supervision actions."

Robotics—an automated material handling system for order fulfillment, inventory storage or racking used in retail restocking, parts distribution and medical device distribution operations. The system is much more efficient and accurate than the traditional method of having human workers traveling around a warehouse locating items with conventional materials handling equipment. Other advantages are dramatic reductions in time and cost savings, reduced physical risk in the workplace for humans, and a higher degree of accuracy in item information tracking, recording and fulfillment.

Security—Facilities security management covers seven areas of building security knowledge: project process, risk assessment, site considerations, building envelope, interior space, facility operations, and the rating system. These areas include the security of the building interior and exterior, access to its equipment, access to the building by personnel, visitors and vendors, efficiency, and the control of physical access to proprietary, confidential or high-risk information.

Referring to FIG. 1 again, it should be understood that this invention relates to an improved burial unit structure which is above-ground or vertical, and the modular construction system thereof; specifically to a burial unit container 12 which may a.) be monolithically systematized by stacking units vertically and/or horizontally above ground to reduce both labor and material costs and, b.) integrate current technologies into the unit during manufacture for post-burial management and maintenance.

As shown in FIG. 1, the container 12 of the present invention may include:

A.) A plurality of rectangular cubicles or hollow receptacles, containers 12, traditionally known as crypts that are stacked either vertically and/or horizontally upon each other or adjacent to each other. The containers 12 consist of and include a top wall (Panel A), first and second opposite side panel faces, (Panel B & C), first and second opposite end panel faces (Panel D & E) and a bottom wall (Panel F). The container 12 construction material may be an injection-molded or extruded polypropylene with compound additives for flame retardancy, moisture penetration barrier control and closing seal bonding affinity. For example PolyFR 200 brand material is a highly loaded non-halogen flame retardant concentrate designed for ease of use in polypropylene compounding and molding processes where FR levels can be metered in to various flame testing and moisture penetration standards for the product. It is recommended at loading levels from 35-50% depending on the resin systems, material thickness, equipment, formulation additives and final flame retardant and moisture barrier requirements. It is recyclable.

B.) Each individual Panel may be constructed by the Extrusion or Injection Molding process by a 750 ton high pressure press using Polypropylene resin that creates a finished panel that supports an independent vertical compression load of 4,400#'s per square inch per each Panel. Each Panel may have twelve independent weight distribution of bearing points with interlocking Male and Female apertures as illustrated. Each container may have a stainless steel imbedded reinforcing pin system, attachment device 30, that secures one container 12 to the other both top and bottom and side to side adjacent in a container array thus creating a secure attachment of the containers to each other. Each pin resisting the sheer force on the container 12 array from the corners of each of said adjacent container 12 are connected together by additional and different stainless steel pins.

C.) The top (Panel A) and bottom (Panel D) has a keyway, tongue and groove 18, whereby Panels B & C fit in the ½" deep keyway and are anchored in place with an affinity poly-bond epoxy cement and stainless steel screws for added strength and sealing to maintain gas release.

D.) Rear Panel E fits in place on the rear of the container 12 and is secured with an affinity poly-bond epoxy cement and (6) ½" stainless steel screws for added strength and sealing to maintain gas release. The panel has a 2" outward one-way stainless steel (non-corrosive) gas pressure relief valve 22 hole at the top of the end panel for connection to exterior plumbing 24 for gas release.

E.) The rear Panel D has (1) ½" inward pressure relief valve, input valve 26, at the top of the end panel for connection to exterior copper line pressure plumbing for inward spraying of a compressed aerosol disinfectant.

F.) On end Panels D and E are embedded six sensor housings with interchangeable sensors 28 for transmit/read by multiple remote data access technologies for monitoring both interior and exterior environment, substance violation and degradation.

G.) Front Panel E fits in place on the front end facing out of the container 12 and is secured in place with (6) ½" stainless steel screws 1" long. (See Exhibit 2, p. 12). At the face of the front Panel F is (4) ¾" threaded holes 1½" deep for mounting a Decorative Exterior Marble Face Plate that is 36"×36" square, for example only.

H.) For achieving plurality of rectangular cubicles or hollow receptacles, traditionally known as crypts, containers 12, that are stacked above-ground either vertically and/or horizontally upon each other or adjacent to each other, a pod cage 48 and anchor system is used. Containers 12 are connected per the block or column configuration required by the exterior construction. All are secured by a stainless steel 4"×4" square tubing racking system embedded into a concrete floor base, for example, and extending upright to the height of (1) foot above the height of the tallest row of containers 12. The 4"×4" square tubing has a 2" threaded stainless steel bolt welded to the top of the tubing. In this manner a vertical and/or horizontal monolithic structure is obtained and maintained.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A burial system for containing and monitoring biological remains comprising:

a. a container with an outer shell surrounding an interior containment space wherein said container is configured to retain the biological remains in said interior containment space;

b. a pressure relief valve connected with said container wherein said pressure relief valve is a one-way valve for release of pressure from said interior containment space;

c. an input valve connected with said container wherein said input valve is a one-way valve for the introduction of material to said interior containment space from an exterior of said container;

d. at least one sensor device connected with said container wherein said at least one sensor device monitors and obtains data from said interior containment space and the exterior of said container; and e. a management information system connected with said container wherein said management information system maintains real time and historical data of said container.

2. The system of claim 1 further including more than one container wherein said management information system includes a central data center for recording said real time and historical data of each of said more than one container wherein said real time and historical data includes data from a group of data consisting of: audible, visual and written data.

3. The system of claim 2 wherein said real time and historical data includes the location of said containers, the contents of said containers, and customer information relating to said containers.

4. The system of claim 1 further including an RFID tag connected with said container.

5. The system of claim 1 further including a gender label on the exterior of said container.

6. The system of claim 1 further including a biohazard label on the exterior of said container.

7. The system of claim 1 further including an attachment device configured to connect said container with an object.

8. The system of claim 7 wherein said attachment device is remotely operable and wherein said object is a pod cage for storage of more than one aid container.

9. The system of claim 1 wherein said pressure relief valve is connected with plumbing directing material released by said pressure relief valve away from said container.

10. A burial system for containing and monitoring human remains, the burial system comprising:

a. a plurality of remains containers wherein each remains container includes an outer shell surrounding an interior containment space and wherein each of said remains containers is configured to retain human remains in said interior containment space;

b. a pressure relief valve connected with each of said remains containers wherein said pressure relief valve is a one-way valve for release of pressure from said interior containment space;

c. an input valve connected with each of said remains containers wherein said input valve is a one-way valve for the introduction of material to said interior containment space from an exterior of said container;

d. at least one sensor device connected with each of said remains containers wherein said at least one sensor device monitors and obtains data from said interior containment space and the exterior of each of said remains containers; and e. a management information system connected with each of said remains containers wherein said management information system maintains real time and historical data of each of said remains containers wherein said management information system includes a central data center for recording said real time and historical data of each of said remains containers and wherein said central data center is connected with a network for management and customer access to said real time and historical data and wherein said real time and historical data includes data from a group of data consisting of: audible, visual and written data relating to said remains containers.

11. The system of claim 10 further including an RFID tag connected with each of said remains containers.

12. The system of claim 10 further including a gender label on the exterior of each of said remains containers.

13. The system of claim 10 further including a biohazard label on the exterior of each of said remains containers.

14. The system of claim 10 further including an attachment device configured to connect said remains container with an object.

15. The system of claim 14 wherein said attachment device is remotely operable and wherein said object is a pod cage for storage of more than one said remains container.

16. The system of claim 10 wherein said pressure relief valve is connected with plumbing directing material released by said pressure relief valve away from said remains container.

17. A burial method for containing and monitoring biological remains comprising:

a. providing a container with an outer shell surrounding an interior containment space wherein said container is configured to retain the biological remains in said interior containment space; a pressure relief valve connected with said container wherein said pressure relief valve is a one-way valve for release of pressure from said interior containment space; an input valve connected with said container wherein said input valve is a one-way valve for the introduction of material to said interior containment space from an exterior of said container; at least one sensor device connected with said container wherein said at least one sensor device monitors and obtains data from said interior containment space and the exterior of said container; and a management information system connected with said container wherein said management information system maintains real time and historical data of said container wherein said real time and historical data includes data from a group of data consisting of: audible, visual and written data; and b. accessing said management information system and retrieving said real time and historical data of said container.

18. The method of claim 17 further including the steps of providing more than one said container and connecting each container with another container in an arrangement selected from a group of arrangements consisting of: vertical stacking arrangement, horizontal stacking arrangement and a combination of vertical and horizontal stacking arrangements.

19. The method of claim 17 further including the steps of providing a pod cage wherein said pod cage is conformed to receive and retain a plurality of said containers and connecting said each of said plurality of containers with said pod cage.

20. The method of claim 17 wherein said management information system includes a central data center for recording said real time and historical data of a plurality of said containers and wherein said central data center is connected with a network for management and customer access to said real time and historical data and wherein said real time and historical data includes the location of each of said containers, the contents of each of said containers, and customer information relating to each of said containers.

* * * * *